US008770682B2

(12) United States Patent
Lee et al.

(10) Patent No.: US 8,770,682 B2
(45) Date of Patent: Jul. 8, 2014

(54) REFRIGERATOR

(75) Inventors: Eun Joo Lee, Gyeongnam (KR); Hang Bok Lee, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/391,632

(22) PCT Filed: Jan. 19, 2011

(86) PCT No.: PCT/KR2011/000373

§ 371 (c)(1),
(2), (4) Date: Feb. 22, 2012

(87) PCT Pub. No.: WO2011/093613

PCT Pub. Date: Aug. 4, 2011

(65) Prior Publication Data

US 2012/0286639 A1 Nov. 15, 2012

(30) Foreign Application Priority Data

Feb. 1, 2010 (KR) ..... 10-2010-0009334
Feb. 1, 2010 (KR) ..... 10-2010-0009335
Feb. 1, 2010 (KR) ..... 10-2010-0009336
Feb. 1, 2010 (KR) ..... 10-2010-0009337
Feb. 1, 2010 (KR) ..... 10-2010-0009338

(51) Int. Cl.
*A47B 97/00* (2006.01)
*A47B 96/04* (2006.01)

(52) U.S. Cl.
USPC ..... 312/291; 312/405

(58) Field of Classification Search
USPC ..... 312/291, 405, 401, 405.1, 402, 312/224–227, 290, 321.5
See application file for complete search history.

(56) References Cited

U.S. PATENT DOCUMENTS 1,927,398 A * 9/1933 Glasser ..... 62/377
2,046,909 A 7/1936 Terry et al.

(Continued)

FOREIGN PATENT DOCUMENTS

CN 1627016 A 6/2008
EP 0 539 558 A1 12/1992

(Continued)

OTHER PUBLICATIONS

PCT International Search Report dated Jul. 28, 2011 for Application No. PCT/KR2011/000373, three pages.

(Continued)

*Primary Examiner* — Darnell Jayne
*Assistant Examiner* — Timothy M Ayres
(74) *Attorney, Agent, or Firm* — Fish & Richardson P.C.

(57) ABSTRACT

A refrigerator is provided. The refrigerator includes a cabinet having a first storage chamber, a plurality of doors which open and close an access opening formed at a front surface of the first storage chamber, a hinge assembly which rotatably couples each door to the cabinet, and a basket assembly rotatably coupled to the cabinet with respect to the hinge assembly, the basket assembly being configured to define a second storage chamber which is received in the first storage chamber. The basket assembly includes a basket frame defining the second storage chamber and a basket mounted on the basket frame to receive food stuff when at least one of the doors is opened. The basket assembly is configured such that an access into the basket is enabled through a front face and rear face of the basket assembly.

19 Claims, 9 Drawing Sheets

(56) References Cited

U.S. PATENT DOCUMENTS

| | | | | | |
|---|---|---|---|---|---|
| 2,051,132 | A | * | 8/1936 | Dart | 62/441 |
| 2,095,811 | A | | 10/1937 | Goulooze | |
| 2,112,771 | A | | 3/1938 | Goulooze | |
| 2,129,923 | A | * | 9/1938 | Frankel | 312/236 |
| 2,130,617 | A | * | 9/1938 | Dockham | 312/291 |
| 2,131,680 | A | * | 9/1938 | Zahodiakin | 62/266 |
| 2,135,878 | A | * | 11/1938 | Sekyra, Sr | 62/252 |
| 2,150,064 | A | * | 3/1939 | Robert et al. | 62/266 |
| 2,213,274 | A | * | 9/1940 | Flamm | 62/265 |
| 2,276,937 | A | * | 3/1942 | Cordova | 222/130 |
| 2,692,813 | A | | 10/1954 | Toronto | |
| 3,140,134 | A | | 7/1964 | Nairn | |
| 3,389,424 | A | | 6/1968 | Fellwock | |
| 3,510,986 | A | * | 5/1970 | Berkowitz | 49/386 |
| 4,087,140 | A | | 5/1978 | Linstromberg | |
| 4,302,907 | A | | 12/1981 | Canals et al. | |
| 4,368,622 | A | | 1/1983 | Brooks | |
| 4,514,021 | A | | 4/1985 | Sundermeier et al. | |
| 5,209,082 | A | | 5/1993 | Ha | |
| 5,966,963 | A | * | 10/1999 | Kovalaske | 62/441 |
| 6,055,823 | A | | 5/2000 | Baker et al. | |
| 6,193,340 | B1 | * | 2/2001 | Schenker et al. | 312/265.5 |
| 6,268,594 | B1 | | 7/2001 | Leutner et al. | |
| 6,375,291 | B1 | | 4/2002 | Nam et al. | |
| 7,008,032 | B2 | * | 3/2006 | Chekal et al. | 312/405 |
| 7,437,885 | B2 | | 10/2008 | Wu | |
| 7,849,707 | B2 | | 12/2010 | Wu | |
| 2005/0188506 | A1 | | 9/2005 | Lee et al. | |
| 2005/0258724 | A1 | | 11/2005 | Hwa | |
| 2006/0005484 | A1 | | 1/2006 | Riblier et al. | |
| 2006/0086135 | A1 | | 4/2006 | Wu | |
| 2006/0265979 | A1 | | 11/2006 | Cording | |
| 2007/0018548 | A1 | | 1/2007 | Ertz et al. | |
| 2009/0255291 | A1 | | 10/2009 | Lee et al. | |
| 2010/0043459 | A1 | | 2/2010 | Wu | |
| 2010/0107679 | A1 | * | 5/2010 | Park et al. | 62/441 |

FOREIGN PATENT DOCUMENTS

| | | | |
|---|---|---|---|
| EP | 1 032 796 | B1 | 6/2002 |
| EP | 1 653 178 | A2 | 5/2006 |
| JP | 56-164495 | U | 12/1981 |
| JP | 63-142682 | U | 9/1988 |
| JP | 06-066473 | A | 3/1994 |
| JP | 10-009757 | A | 1/1998 |
| JP | 2000-065459 | A | 3/2000 |
| JP | 2001-108357 | A | 4/2001 |
| JP | 2002-228342 | A | 8/2002 |
| JP | 2002-323287 | A | 11/2002 |
| JP | 2006-038437 | A | 2/2006 |
| JP | 2009-103395 | A | 5/2009 |
| KR | 1990-0008203 | Y1 | 9/1990 |
| KR | 1996-0011364 | A | 4/1996 |
| KR | 20-19980018920 | A | 7/1998 |
| KR | 1999-042339 | A | 6/1999 |
| KR | 1999-062159 | A | 7/1999 |
| KR | 1999-037440 | A | 10/1999 |
| KR | 1999-0039593 | A | 11/1999 |
| KR | 20-0164322 | Y1 | 2/2000 |
| KR | 20-0168373 | Y1 | 2/2000 |
| KR | 2002-0083115 | A | 11/2002 |
| KR | 10-0376167 | B1 | 3/2003 |
| KR | 20-0314145 | Y1 | 5/2003 |
| KR | 10-2003-0083812 | A | 11/2003 |
| KR | 10-2003-0083813 | A | 11/2003 |
| KR | 2003-0083813 | A | 11/2003 |
| KR | 10-2004-0080072 | A | 9/2004 |
| KR | 10-2005-0103722 | A | 11/2005 |
| KR | 2005-0111094 | A | 11/2005 |
| KR | 10-2006-0027445 | A | 3/2006 |
| KR | 10-0596533 | B1 | 7/2006 |
| KR | 20-0420472 | Y1 | 7/2006 |
| KR | 10-2006-0115838 | A | 11/2006 |
| KR | 10-0733309 | B1 | 6/2007 |
| KR | 10-00774019 | B1 | 8/2007 |
| KR | 10-00813686 | B1 | 3/2008 |
| KR | 10-0887575 | B1 | 3/2009 |
| KR | 2009-0077564 | A | 7/2009 |
| KR | 10-2009-0131139 | A | 12/2009 |
| RU | 2243462 | C2 | 12/2004 |
| WO | WO 2004/059228 | A1 | 7/2004 |

OTHER PUBLICATIONS

Russian Notice of Allowance dated Aug. 20, 2013 for Application No. 201146538/13 with English Translation, 18 pages.

Korean Notice of Allowance dated Aug. 9, 2013 for Application No. 10-2010-0009337 with English Translation, 3 pages.

* cited by examiner

REFRIGERATOR

CROSS REFERENCE TO RELATED APPLICATIONS

This application is a U.S. National Phase Application under 35 U.S.C. §371 of International Application PCT/KR2011/000373, filed on Jan. 19, 2011, which claims the benefit of Korean Application Nos. 10-2010-0009334, 10-2010-0009335, 10-2010-0009336, 10-2010-0009337 and 10-2010-0009338, filed on Feb. 1, 2010, the entire contents of which are hereby incorporated by reference in their entireties.

DESCRIPTION

1. Technical Field

The present disclosure relates to a refrigerator.

2. Background Art

A refrigerator is a home appliance that can store products received in a storage chamber in a frozen or refrigerated state using cold air generated through heat-exchange with refrigerant that circulates through a cooling cycle. The refrigerator includes a cabinet having a storage chamber and a door rotatably disposed on the cabinet to selectively open or close the storage chamber.

Generally, a basket for receiving products is disposed on a back surface of the door. Thus, since the door is substantially increased in weight, a relatively large force may be required for opening or closing the storage chamber.

Also, when the door is rotated to take the products in or out of the basket, the storage chamber is substantially opened and exposed to the outside. Thus, cold air within the storage chamber may unnecessarily leak to the outside.

DISCLOSURE OF INVENTION

Technical Problem

Embodiments provide a refrigerator configured to easily open or close a door.

Embodiments also provide a refrigerator in which leaking of cold air can be minimized in taking in or out of products.

Solution to Problem

In one embodiment, a refrigerator includes: a cabinet having a first storage chamber; a plurality of doors which open and close an access opening formed at a front surface of the first storage chamber; a hinge assembly which rotatably couples each door to the cabinet; and a basket assembly rotatably coupled to the cabinet with respect to the hinge assembly, the basket assembly being configured to define a second storage chamber which is received in the first storage chamber, wherein the basket assembly includes: a basket frame defining the second storage chamber; and a basket mounted on the basket frame to receive food stuff when at least one of the doors is opened, wherein the basket assembly is configured such that an access into the basket is enabled through a front face and rear face of the basket assembly.

In another embodiment, a refrigerator includes: a cabinet including a first storage chamber; a basket assembly defining a second storage chamber which is selectively accommodated in the first storage chamber; at least one door disposed in front of the basket assembly to open or close an access opening of the first storage chamber and/or a front surface of the basket assembly; a first gasket provided on one of a rear surface of the door and a front surface of the basket assembly; a second gasket provided on one of a rear surface of the door and a front surface of the cabinet; and a hinge assembly coupling the basket assembly and the door rotatably to the cabinet.

In further another embodiment, a refrigerator includes: a cabinet configured to define an exterior boundary of the refrigerator; a storage chamber defined by interior walls of the cabinet and configured to store food stuffs, the storage chamber having an access opening; a first door configured to open and close the access opening of the storage chamber by rotating, the first door defined by a basket frame; a second door configured to open and close a portion of an access opening of the first door and having a sealing member; and a third door configured to open and close the other portion the access opening of the first door and having a sealing member, wherein a rotational direction of the second door and the third door is the same as that of the first door, wherein a front surface of the second door is positioned to be generally coplanar with at least a portion of a front surface of the third door, wherein the sealing members of the second door and the third door selectively contact the cabinet.

The details of one or more embodiments are set forth in the accompanying drawings and the description below. Other features will be apparent from the description and drawings, and from the claims.

Advantageous Effects of Invention

According to the embodiments, the door may be easily opened or closed, and the leaking of the cold air may be minimized in the taking in or out of products.

Also, according to the embodiments, foods may be effectively received into the second storage chamber by the plurality of baskets disposed vertically.

Also, since the plurality of baskets is separated from the receiving device and withdrawn to the outside through the opening of the first door, the foods may be easily taken in or out of the plurality of baskets.

Also, since the second door has a left-right length equal to that of the first door, a sense of beauty of the refrigerator door may be improved.

Also, the storage chamber of the first door may have a large size to improve the receiving efficiency.

Also, since the second door is rotated in the same direction as that of the first door, the storage chamber having the large size may be easily opened or closed to improve convenience of use.

MODE FOR THE INVENTION

Reference will now be made in detail to the embodiments of the present disclosure, examples of which are illustrated in the accompanying drawings. However, the sprit of the present disclosure is not limited to the embodiments, and other embodiments by modifications, additions, and deletions of other element also fall on the sprit of the present disclosure.

Figure 1:
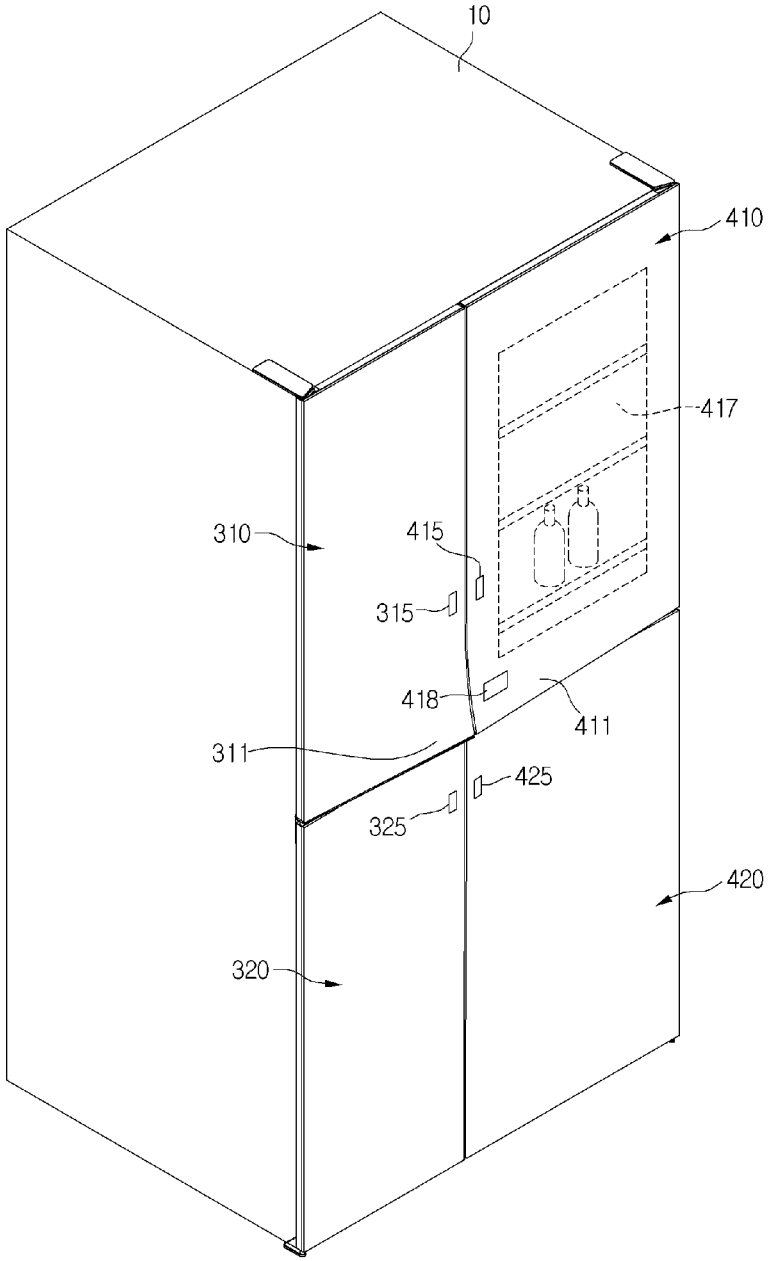
FIG. 1 is a perspective view illustrating an outer appearance of a refrigerator according to an embodiment.
Figure 2:
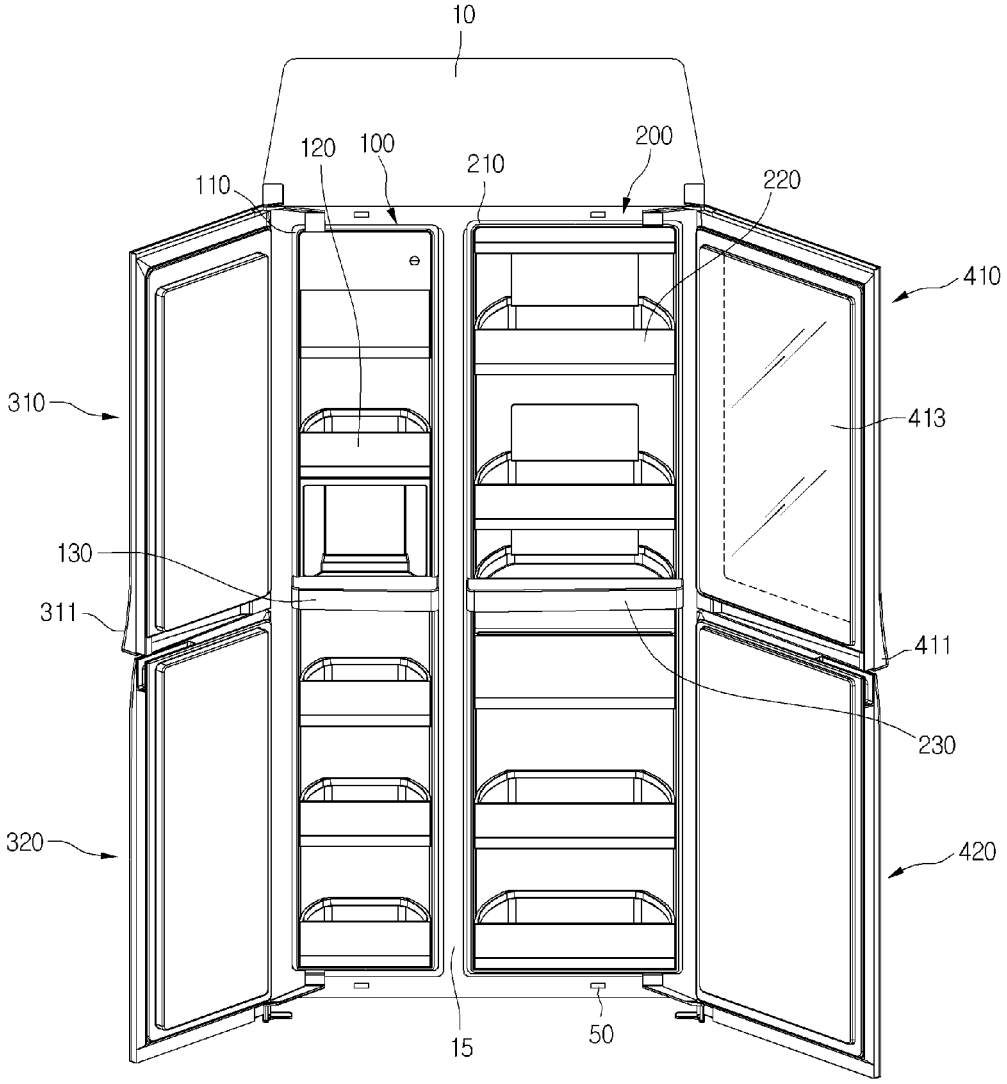
FIG. 2 is a perspective view illustrating a state in which a basket assembly of the refrigerator is opened according to an embodiment.
Figure 3:
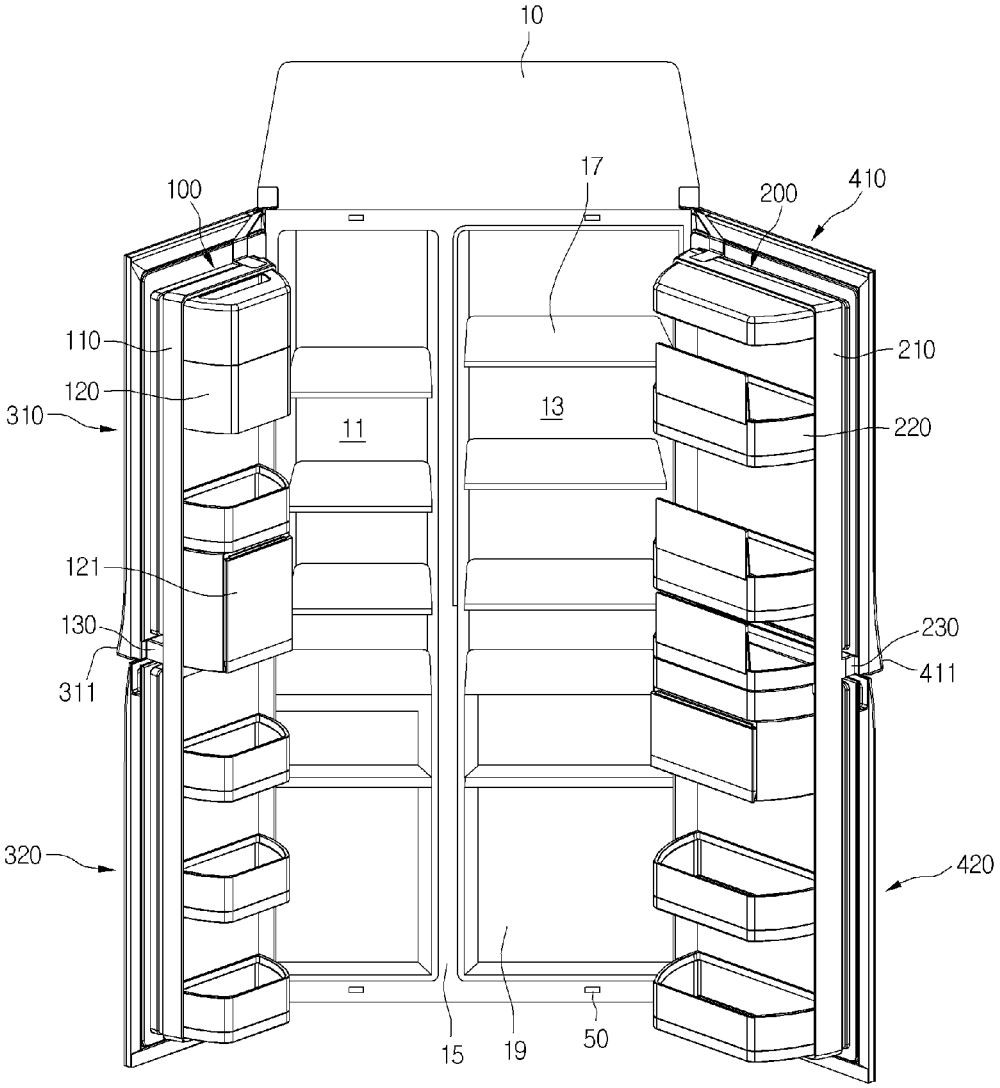
FIG. 3 is a perspective view illustrating a state in which a refrigerating compartment and a freezing compartment are opened according to an embodiment.

FIG. 1 is a perspective view illustrating an outer appearance of a refrigerator according to an embodiment. FIG. 2 is a perspective view illustrating a state in which a basket assembly of the refrigerator is opened according to an embodiment. FIG. 3 is a perspective view illustrating a state in which a refrigerating compartment and a freezing compartment are opened according to an embodiment.

Referring to FIGS. 1 to 3, a storage chamber is defined inside a cabinet 10 of a refrigerator according to an embodiment. The storage chamber stores products to be stored in a frozen or refrigerated state. In the current embodiment, the storage chamber is partitioned into a freezing compartment 11 and a refrigerating compartment 13 by a barrier 15 vertically disposed inside the cabinet 10. That is, the refrigerator according to the current embodiment may be a side by side type refrigerator. Also, front surfaces of the freezing compartment 11 and the refrigerating compartment 13 are opened, and the products to be stored in the frozen or refrigerated state are accessed through the opened front surfaces of the freezing compartment 11 and the refrigerating compartment 13.

A plurality of shelves 17 and a receiving box 19 are disposed inside each of the freezing compartment 11 and the refrigerating compartment 13. The shelves 17 substantially vertically partition the freezing compartment 11 and the refrigerating compartment 13, and the products to be stored in the frozen or refrigerated state are seated on the shelves 17. The receiving box 19 may be accessed into/from the freezing compartment 11 or the refrigerating compartment 13. The products to be stored in frozen or refrigerated state are received into the receiving box 19.

The opened front surfaces of the freezing compartment 11 and the refrigerating compartment 13 are selectively opened or closed by basket assemblies 100 and 200. Substantially, the basket assemblies 100 and 200 are separated toward the outside of the freezing compartment 11 and the refrigerating compartment 13 to open or close the front surfaces of the freezing compartment 11 and the refrigerating compartment 13, respectively. The cabinet 10 is rotatably installed on the basket assemblies 100 and 200. Hereinafter, for convenience of description, the basket assembly for opening or closing the front surface of the freezing compartment 11 is referred to as a freezing compartment basket assembly 100, and the basket assembly for opening or closing the front surface of the refrigerating compartment 13 is referred to as a refrigerating compartment basket assembly 200.

Each of the freezing compartment basket assembly 100 and the refrigerating compartment basket assembly 200 includes basket frames 110 and 210 and a plurality of baskets 120 and 220. Each of the basket frames 110 and 210 has an empty frame shape with an inner space. The basket frames 110 and 210 are rotatably installed on the cabinet 10. Also, the baskets 120 and 220 are detachably installed on the basket frames 110 and 120, respectively. Substantially, the products to be stored in the frozen or refrigerated state are received into the baskets 120 and 220 through opened front or rear surfaces of the freezing compartment basket assembly 110 and the refrigerating compartment basket assembly 200.

Portions of the rear surfaces of the freezing compartment basket assembly 100 and the refrigerating compartment basket assembly 200 may be selectively opened or closed by a basket door 121. Substantially, the basket door 121 opens or closes portions of rear surfaces of the freezing compartment basket assembly 100 and the refrigerating compartment basket assembly 200 corresponding between the baskets 120 and 220 adjacent to each other. For example, since the basket door 121 is rotatably installed on one of the baskets 120 and 220, the basket door 121 may open or close portions of the rear surfaces of the freezing compartment basket assembly 100 and the refrigerating compartment basket assembly 200.

Also, door handles 130 and 230 are disposed on the freezing compartment basket assembly 100 and the refrigerating compartment basket assembly 200, respectively. The door handles 130 and 230 are horizontally disposed on sides of the front surfaces of the freezing compartment basket assembly 100 and the refrigerating compartment basket assembly 200, substantially, sides of front surfaces of the frames 110 and 210. The door handles 130 and 230 are grasped by a user to rotate the freezing compartment basket assembly 100 and the refrigerating compartment basket assembly 200 with respect to the cabinet 10. That is, when the user pulls forward the door handles 130 and 230 in a state where the user grasps the door handles 130 and 230, the freezing compartment basket assembly 100 and the refrigerating compartment basket assembly 200 with respect to the cabinet 10 are rotated and withdrawn to the outside of the freezing compartment 11 or the refrigerating compartment 13.

In the current embodiment, each of the door handles 130 and 230 extends in a horizontal direction in a state where they protrude forward from the front surfaces of the frames 110 and 210. Grasping grooves 131 and 231 are defined in the door handles 130 and 230, respectively. Substantially, the grasping grooves 131 and 231 are places at which user's fingers for grasping the door handles 130 and 230 are positioned. The grasping grooves 131 and 231 are recessed upward from bottom surfaces of the door handles 130 and 230, respectively.

The front surfaces of the freezing compartment basket assembly 100 and the refrigerating compartment basket assembly 200 are selectively opened or closed by freezing compartment doors 310 and 320 and refrigerating compartment doors 410 and 420, respectively. Also, the freezing compartment doors 310 and 320 and the refrigerating compartment doors 410 and 420 are rotatably installed on the cabinet 10, like the freezing compartment basket assembly 100 and the refrigerating compartment basket assembly 200.

In a state where the freezing compartment doors 310 and 320 and the refrigerating compartment doors 410 and 420 respectively close the front surfaces of the freezing compartment basket assembly 100 and the refrigerating compartment basket assembly 200 disposed inside the freezing compartment 11 or the refrigerating compartment 13, edges of back surfaces of the freezing compartment doors 310 and 320 and the refrigerating compartment doors 410 and 420 are closely attached to the front surface of the cabinet 10. A plurality of slots 50 is disposed on positions adjacent to rotation centers of the doors on the front surface of the cabinet 10. A function of the respective slots 50 will be described later.

In the current embodiment, the freezing compartment doors 310 and 320 and the refrigerating compartment doors 410 and 420 include first and second freezing compartment doors 310 and 320 and first and second refrigerating compartment doors 410 and 420, respectively. The first and second freezing compartment doors 310 and 320 selectively open or close upper and lower sides of the front surface of the freezing compartment basket assembly 100, respectively. Also, the first and second refrigerating compartment doors 410 and 420 selectively open or close upper and lower sides of the front surface of the refrigerating compartment basket assembly 200, respectively. That is, in the current embodiment, the front surface of the freezing compartment 11 or the refrigerating compartment 13 is opened or closed by one freezing compartment basket assembly 100 or one refrigerating compartment basket assembly 200. The front surfaces of the freezing compartment basket assembly 100 and the refrigerating compartment basket assembly 200 are selectively opened or closed by the first and second freezing compartment doors 310 and 320 and the first and second refrigerating compartment doors 410 and 420.

A bottom surface of the first freezing compartment door 310 is spaced a predetermined distance from a top surface of the second freezing compartment door 320, and a bottom surface of the first refrigerating compartment door 410 is spaced a predetermined distance from a bottom surface of the second refrigerating compartment door 420. This is done for a reason that the user grasps the door handles 130 and 230 through the spaces between the first and second freezing compartment doors 310 and 32 and between the first and second refrigerating compartment doors 410 and 420.

Handle shield parts 311 and 411 are disposed on a lower end of the first freezing compartment door 310 and a lower end of the first freezing compartment door 410, respectively. Also, the handle shield parts 311 and 411 constitute portions of the first and second freezing compartment doors 310 and 410, respectively. The handle shield parts 311 and 411 may be inclined or curved with respect to the front surface of the first or second freezing compartment door 310 or 410. When the doors 310 and 410 are closed, back surfaces of the handle shield parts 311 and 411 are closely attached to front surfaces of the door handles 130 and 230. As a result, the door handles 130 and 230 are not exposed forward by the handle shield parts 311 and 411.

Also, a viewing window 417 may be disposed in the first refrigerating compartment door 410. The viewing window 417 may be formed of a transparent material. The user may selectively look into the inside of the refrigerating compartment basket assembly 200 through the viewing window 417. For example, only when the refrigerating compartment basket assembly 200 is illuminated by a refrigerating compartment basket lighting source 240 that will be described later, the user may look into the inside of the refrigerating compartment basket assembly 200 through the viewing window 417. For this, a lighting button 418 may be disposed at a side of the first refrigerating compartment door 410. The lighting button 418 receives a signal for turning on/off the refrigerating compartment basket lighting source 240.

Figure 4:
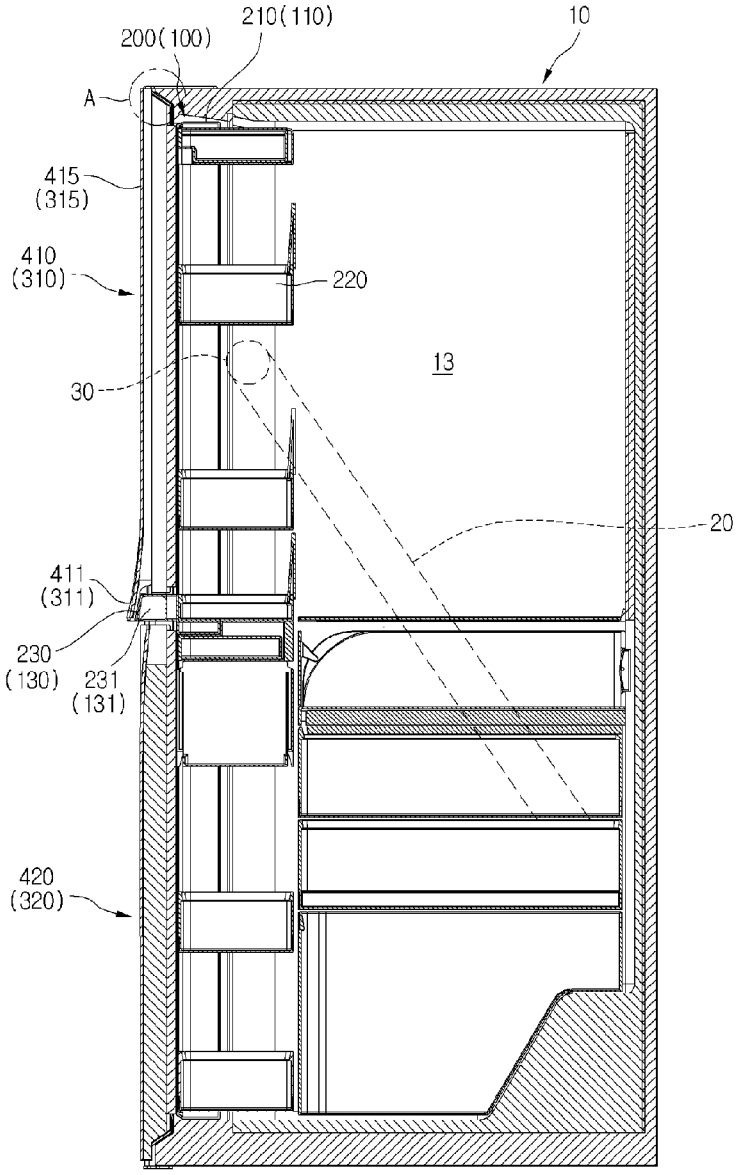
FIG. 4 is a side-sectional view illustrating an inner structure of the refrigerator according to an embodiment.

FIG. 4 is a side-sectional view illustrating an inner structure of the refrigerator according to an embodiment.

Referring to FIG. 4, a cool air supply duct 20 is disposed in the cabinet 10. The cool air supply duct 20 supplies cool air to the refrigerating compartment basket assembly 200. The cool air supply duct 20 is disposed inside the barrier 15. Here, the cool air supply duct 20 may have one end directly communicating with a heat exchange chamber (not shown) in which an evaporator (not shown) is received. Also, a cool air supply hole 30 may be defined in the barrier 15, and a discharge hole of the cool air supply duct 20 may connected to the cool air supply hole 30. Thus, cool air flowing along the cool air supply duct 20 is discharged into the refrigerating compartment or the freezing compartment through the cool air supply hole 30. Substantially, the cool air supply hole 30 may be disposed adjacent to the refrigerating compartment basket assembly 200 corresponding between the baskets 120 and 220 adjacent to each other.

Although not shown, a separate cool air supply duct and cool air supply hole for supplying the cool air into the freezing compartment basket assembly 100 and the refrigerating compartment basket assembly 200 may be additionally provided. The cool air supply duct and cool air supply hole for supplying the cool air into the freezing compartment basket assembly 100 and the refrigerating compartment basket assembly 200 may have constitutions substantially similar to those of the cool air supply duct 20 and cool air supply hole 30.

Figure 5:
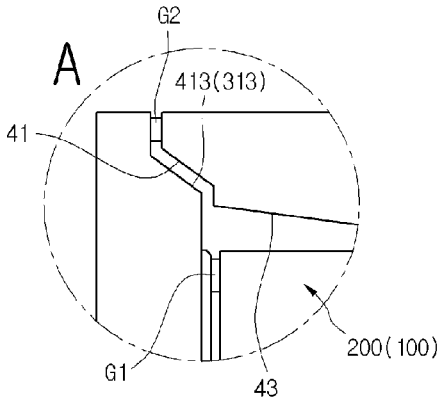
FIG. 5 is an enlarged view illustrating a portion A of FIG. 4.

FIG. 5 is an enlarged view illustrating a portion A of FIG. 4.

Referring to FIG. 5, first and second inclined surfaces 41 and 43 are disposed on the front surface of the cabinet 10. The first inclined surface 41 is inclined downward from an edge of the front surface of the cabinet 10 toward the inside of the cabinet 10. The second inclined surface 43 is inclined downward from a lower end of a portion stepped downward from a rear end of the first inclined surface 41 toward the inside of the cabinet 10. Here, the first and second inclined surfaces 41 and 43 may be inclined at angles different from each other.

The first and second inclined surfaces 41 and 42 are disposed to prevent the cool air within the freezing compartment 11 or the refrigerating compartment 13 from leaking. That is, a cool air passage may have a more complicated structure to minimize the leaking of the cool air. In other words, since contact areas between the cabinet 10 and the freezing compartment doors 310 and 320 and between the cabinet 10 and the refrigerating compartment doors 410 and 420 are substantially increased by the first inclined surface 41 and door liners 313 and 413 that will be described later, it may efficiently y prevent the cool air within the freezing compartment 11 and the refrigerating compartment 13 from leaking.

A second hinge bracket 520 that will be described later is disposed on the second inclined surface 43. In other words, the second hinge bracket 520 is disposed in a space between the second inclined surface 43 and top surfaces of the freezing and refrigerating compartment basket assemblies 100 and 200. Thus, due to the second inclined surface 43, it may prevent the cabinet 10 and the second hinge bracket 520 from interfering with each other in a process in which the freezing compartment basket assembly 100 and the refrigerating compartment basket assembly 200 are rotated.

The door liners 313 and 413 are disposed on back surfaces of the freezing compartment doors 310 and 320 and the refrigerating compartment doors 410 and 420. Edges of the back surfaces of the freezing compartment doors 310 and 320 and the refrigerating compartment doors 410 and 420 are inclined at an angle corresponding to that of the first inclined surface 41 to form the door liners 313 and 413. The first inclined surface 41 and the door liners 313 and 413 may substantially minimize a gap between the cabinet 10 and the freezing and refrigerating compartment doors 310, 320, 410, and 420 to minimize the leaking of the cool air within the freezing compartment 11 and the refrigerating compartment 13.

First and second gaskets G1 and G2 are disposed on the back surfaces of the freezing compartment doors 310 and 320 and the refrigerating compartment doors 410 and 420, respectively. The first and second gaskets G1 and G2 are selectively closely attached to the front surfaces of the freezing compartment basket assembly 100 and the refrigerating compartment basket assembly 200 and the front surface of the cabinet 10, respectively. The first and second gaskets G1 and G2 may be disposed on the back surfaces of the freezing compartment doors 310 and 320 and the refrigerating compartment doors 410 and 420, respectively. However, the present disclosure is not limited thereto. For example, the gaskets G1 and G2 may be disposed on the front surfaces of the freezing compartment basket assembly 100 and the refrigerating compartment basket assembly 200, i.e., the front surfaces of the frames 110 and 210 and the front surface of the cabinet 10, respectively.

The second gasket G2 is disposed outside the first gasket G1. In the current embodiment, the first and second gaskets G1 and G2 are separately manufactured and spaced from each other.

In more detail, the first gasket G1 may primarily prevent the cool air within the freezing compartment basket assembly 100 and the refrigerating compartment basket assembly 200 from leaking to the outside in a state where the freezing compartment doors 310 and 320 and the refrigerating compartment doors 410 and 420 are respectively closely attached on the front surfaces of the freezing compartment basket assembly 100 and the refrigerating compartment basket assembly 200. For this, the first gasket G1 is disposed between the front surfaces of the freezing compartment basket assembly 100 and the refrigerating compartment basket assembly 200 and the back surfaces of the freezing compartment doors 310 and 320 and the refrigerating compartment doors 410 and 420 to shield a gap therebetween.

The second gasket G2 may secondarily prevent the cool air within the freezing compartment 11 or the refrigerating compartment 13 from leaking to the outside in a state where the freezing compartment basket assembly 100 and the refrigerating compartment basket assembly 200 are received inside the freezing compartment 11 or the refrigerating compartment 13. For this, the second gasket G2 is disposed between the front surface of the cabinet 10 and the back surfaces of the freezing compartment doors 310 and 320 and the refrigerating compartment doors 410 and 420 to shield a gap therebetween.

A magnet may be inserted inside at least one of the first and second gaskets G1 and G2 to closely attach the back surfaces of the freezing compartment doors 310 and 320 and the refrigerating compartment doors 410 and 420 to the first and second gaskets G1 and G2.

Figure 6:
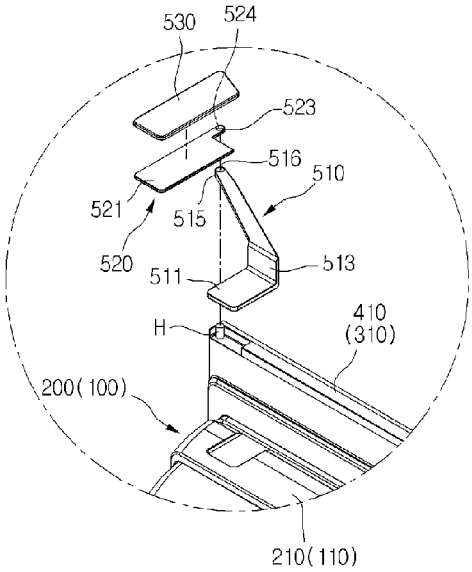
FIG. 6 is an exploded perspective view illustrating a hinge structure of a refrigerator door according to an embodiment.

FIG. 6 is an exploded perspective view illustrating a hinge structure of a refrigerator door according to an embodiment.

Referring to FIG. 6, a plurality of hinge brackets 510 and 520 is disposed to rotatably support the freezing and refrigerating compartment basket assemblies 100 and 200 and the freezing and refrigerating compartment doors 310, 320, 410, and 420 to the cabinet 10. Hereinafter, for convenience of description, the hinge bracket for rotatably supporting the freezing and refrigerating compartment basket assemblies 100 and 200 to the cabinet 10 is referred to as a first hinge bracket 510, and the hinge bracket for rotatably supporting the freezing and refrigerating compartment doors 310, 320, 410, and 420 to the cabinet 10 is referred to as a second hinge bracket 520.

The first hinge bracket 510 includes a frame fixing part 511, a connection part 513, and a first hinge coupling part 515. The frame fixing part 511 is fixed to top and bottom surfaces of the frames 100 and 210. That is, the frame fixing part 511 is disposed between the second inclined surface 43 and the frames 110 and 210. Thus, the frame fixing part 511 is not exposed to the outside in a state where the basket assemblies 100 and 200 are received inside the cabinet 10.

Also, the connection part 513 is bent at a front end of the frame fixing part 511 and extends from the front end of the frame fixing part 511. The frame fixing part 511 disposed on the top surfaces of the frames 110 and 210 is bent upward, and the frame fixing part 511 disposed on the bottom surface of the frames 110 and 210 is bent downward. The connection part 513 operates a first door switch 71 that will be described later. For this, the connection part 513 contacts the front surface of the cabinet 10 in a state where the freezing compartment basket assembly 100 and the refrigerating compartment basket assembly 200 are respectively received into the freezing compartment 11 or the refrigerating compartment 13. The first hinge coupling part 515 is curved laterally from a front end of the connection part 513 and horizontally extends. A first hinge hole 516 passing through a hinge shaft H that will be described later is defined in the first hinge coupling part 515.

The second hinge bracket 520 includes a cabinet fixing part 521 and a second hinge coupling part 523. The cabinet fixing part 521 is fixed to an edge of the top or bottom surface of the cabinet 10. The second hinge coupling part 523 extends to a predetermined length from a front end of the cabinet fixing part 521 toward a front side of the cabinet 10. Substantially, the second hinge coupling part 523 vertically overlaps the first hinge coupling part 515. A second hinge hole 524 is defined in the second hinge coupling part 523. The hinge shaft H passes through the second hinge hole 524.

Two hinge shafts H may be provided to rotatably install the back surfaces of the freezing compartment doors 310 and 320 and the refrigerating compartment doors 410 and 420 on the cabinet 10. The hinge shaft H vertically extends from a top surface of the first freezing compartment door 310 and a bottom surface of the second freezing compartment door 320 to sequentially pass through the first hinge hole 516 and the second hinge hole 523. This structure may be equally applied to the first and second refrigerating compartment doors 410 and 420. Thus, the basket assemblies 100 and 200 and the doors 310, 320, 410, and 420 are rotated around the same rotation axis.

The second hinge bracket 520 is shielded by a hinge cover 530. For this, the hinge cover 530 may have a shape and size enough to shield the whole second hinge bracket 520.

Figure 7:
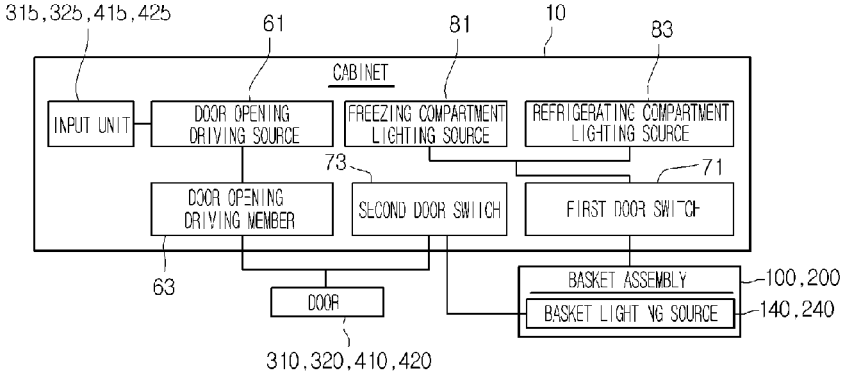
FIG. 7 is a schematic block diagram illustrating a configuration of a door opening mechanism according to an embodiment.

FIG. 7 is a schematic block diagram illustrating a configuration of a door opening mechanism according to an embodiment.

Referring to FIG. 7, the refrigerator according to the current embodiment includes a door opening mechanism. The door opening mechanism automatically opens one of the first and second freezing compartment doors 310 and 320 and the first and second refrigerating compartment doors 410 and 420 at a predetermined angle to open the front surfaces of the freezing compartment basket assembly 100 and the refrigerating compartment basket assembly 200 in a state where the freezing compartment basket assembly 100 and the refrigerating compartment basket assembly 200 are received inside the freezing compartment 11 and the refrigerating compartment 13. For this, the door opening mechanism may includes input units 315, 325, 415, and 425, a door opening driving source 61, and a door opening driving member 63.

In detail, the input units 315, 325, 415, and 425 may be disposed on the front surfaces of the freezing compartment doors 310 and 320 or the refrigerating compartment doors 410 and 420. Also, the input units 315, 325, 415, and 425 may receive a door opening signal in a touch button manner using an electrostatic capacitance variation and a mechanical button manner. Alternatively, the input units 315, 325, 415, and 425 may receive the door opening signal using a separate remote control.

The door opening driving source 61 provides a driving force for opening the freezing compartment doors 310 and 320 and the refrigerating compartment doors 410 and 420 according to a signal inputted through the input units 315, 325, 415, and 425 to the door opening driving member 63. In detail, for example, a forward/reverse rotation motor may be used as the door opening driving source 61. When the door opening driving source 61 receives the door opening signal from the input units 315, 325, 415, and 425, the door opening driving source 61 is rotated in one direction (hereinafter, for convenience of description, referred to as a 'forward direction') to provide a driving force for opening the freezing compartment doors 310 and 320 and the refrigerating compartment doors 410 and 420 for a preset operation time. Here, the forward driving force of the door opening driving source 61 exceeds an attaching force of the second gasket G2. Also, the door opening driving source 61 may be rotated in the other direction (hereinafter, for convenience of description, referred to as a 'reverse direction') by an elapsed set time or a door closing signal to provide a driving force to the door opening driving member 63.

The door opening driving member 63 pushes the freezing compartment doors 310 and 320 and the refrigerating compartment doors 410 and 420 by the driving force provided from the door opening driving source 61. In detail, for example, the door opening driving member 63 may have a disk shape having a set central angle. Also, the door opening driving member 63 is received inside the slot 50. The door opening driving member 63 may be disposed to take it in/out the cabinet 10 through the slot 50. Here, the door opening driving member 63 protrudes from the slot 50 to the outside of the cabinet 10 by the forward rotation of the door opening driving source in to push the freezing compartment doors 310 and 320 and the refrigerating compartment doors 410 and 420. The door opening driving member 63 may be taken in the slot 50 by the reverse rotation of the door opening driving source after a set time elapses from a time point at which the rotation of the door opening driving source 61 in the forward direction is ended. Here, it is not necessary to use the forward/reverse rotation motor as the door opening driving source 61. For example, when the door opening driving source 61 is rotated forwardly at about 180 degrees, the door opening driving member 63 may be taken out the slot 50. Also, when the door opening driving source 61 is rotated forwardly at about 360 degrees, the door opening driving member 63 may be completely taken in the slot 50.

Substantially, the door opening driving member 63 pushes the freezing compartment doors 310 and 320 and the refrigerating compartment doors 410 and 420 to open the freezing compartment doors 310 and 320 and the refrigerating compartment doors 410 and 420 at a set angle with respect to the cabinet 10. Here, the opened angle may be determined in consideration of the attaching force of the second gasket G2.

First and second door switches 71 and 73 may be disposed on the front surface of the cabinet 10. The first door switch 71 detects whether the freezing compartment basket assembly 100 and the refrigerating compartment basket assembly 200 are rotated. Also, the second door switch 73 detects whether the freezing compartment doors 310 and 320 and the refrigerating compartment doors 410 and 420 are rotated. Thus, the number of first door switch 71 corresponds to those of the freezing compartment basket assembly 100 and the refrigerating compartment basket assembly 200, and the number of second door switch 73 corresponds to those of the freezing compartment doors 310 and 320 and the refrigerating compartment doors 410 and 420. That is, in the current embodiment, two first door switches 71 may be provided, and four second door switches 73 may be provided.

In detail, the first door switch 71 may be disposed on the front surface of the cabinet 10. Specifically, the first door switch 71 may protrude to a region in which the first door switch 71 contacts the back surface of the connection part 513. Thus, when the freezing compartment basket assembly 100 and the refrigerating compartment basket assembly 200 are received inside the freezing compartment 11 or the refrigerating compartment 13, the first door switch 71 is pushed by the connection part 513 to detect the take-in of the basket assemblies 100 and 200. When the freezing compartment basket assembly 100 and the refrigerating compartment basket assembly 200 are taken out of the freezing compartment 11 or the refrigerating compartment 13, the first door switch 71 may be exposed to the outside of the cabinet 10.

Hereinafter, when the first door switch 71 is pushed by the connection part 513, the first door switch 71 may be turned off. Also, when the first door switch 71 is exposed to the outside of the cabinet 10, the first door switch 71 may be turned on. These operations may be equally applied to an on/off operation of the second door switch 73 by the freezing compartment doors 310 and 320 and the refrigerating compartment doors 410 and 420.

When the second door switch 73 is exposed from a side of the front surface of the cabinet 10 to the outside, the second door switch 73 may be located at any position spaced laterally from the first door switch 73. When the freezing compartment doors 310 and 320 or the refrigerating compartment doors 410 and 420 are closely attached to the front surface of the cabinet 10, the second door switch 73 is pushed and inserted into the cabinet 10. Thus, the second door switch 73 is turned off.

A freezing compartment lighting source 81 and a refrigerating compartment lighting source 83 may be disposed in the freezing compartment 11 and the refrigerating compartment 13, which are disposed inside the cabinet 10, respectively. The compartment lighting source 81 and the refrigerating compartment lighting source 83 are turned on/off according to an on/off operation of the first door switch 71 to selectively illuminate the insides of the freezing compartment 11 and the refrigerating compartment 13. That is, the compartment lighting source 81 and the refrigerating compartment lighting source 83 respectively illuminate the freezing compartment 11 and the refrigerating compartment 13 when the freezing compartment basket assembly 100 and the refrigerating compartment basket assembly 200 are rotated and taken out of the freezing compartment 11 and the refrigerating compartment 13 to allow the first door switch 71 to be turned on.

Basket lighting sources 140 and 240 may be disposed in the freezing compartment basket assembly 100 and the refrigerating compartment basket assembly 200, respectively. The basket lighting sources 140 and 240 are turned on/off according to an on/off operation of the second door switch 73 to selectively illuminate the insides of the freezing compartment basket assembly 100 and the refrigerating compartment basket assembly 200. That is, when the freezing compartment doors 310 and 320 or the refrigerating compartment doors 410 and 420 to open the front surfaces of the freezing compartment basket assembly 100 and the refrigerating compartment basket assembly 200, the second door switch 73 is turned on to illuminate the insides of the freezing compartment basket assembly 100 and the refrigerating compartment basket assembly 200. Hereinafter, the lighting source for illuminating the inside of the freezing compartment basket assembly 100 is referred to as a freezing compartment basket lighting source 140, and the lighting source for illuminating the inside of the refrigerating compartment basket assembly 200 is referred to as a refrigerating compartment basket lighting source 240.

Here, the freezing compartment basket lighting source 140 may illuminate the inside of the freezing compartment basket assembly 100 when only one of the first and second freezing compartment doors 310 and 320 for opening or closing the freezing compartment basket assembly 100 is opened. Also, like the freezing compartment basket lighting source 140, the refrigerating compartment basket lighting source 240 may be turned on through the same manner as the freezing compartment basket lighting source 140 to illuminate the inside of the refrigerating compartment basket assembly 200. However, as described above, the refrigerating compartment basket lighting source 240 may be turned on also when an input signal is applied to the lighting button 418.

Hereinafter, an operation of the refrigerator according to an embodiment will be described in detail. For convenience of description, only a process for opening or closing the refrigerating compartment of the storage chamber will be described. However, the current embodiment may be equally applied to the freezing compartment.

First, when products are not accessed, the front surface of the refrigerating compartment 13 and the front and rear surfaces of the refrigerating compartment basket assembly 200 are shielded. In more detail, the refrigerating compartment basket assembly 200 is disposed inside the refrigerating compartment 13. The front surface of the refrigerating compartment basket assembly 200 disposed inside the refrigerating compartment 13 is shielded by the refrigerating compartment doors 410 and 420, i.e., the first and second refrigerating compartment doors 410 and 420. Here, the first and second gaskets G1 and G2 disposed on the back surfaces of the first and second refrigerating compartment doors 410 and 420, substantially, the first and second refrigerating compartment doors 410 and 420 are closely attached to the front surface of the refrigerating compartment basket assembly 200 and the front surface of the cabinet 10, respectively. Thus, it may prevent the cool air within the refrigerating compartment 13 and the refrigerating compartment basket assembly 200 from leaking.

Also, in a state where the refrigerating compartment basket assembly 200 is disposed inside the refrigerating compartment 13 and the front surface of the refrigerating compartment basket assembly 200 is shielded by the first and second refrigerating compartment doors 410 and 420, the first and second door switches 71 and 72 are pushed by the refrigerating compartment basket assembly 200 and the first and second refrigerating compartment doors 410 and 420 and are inserted into the cabinet 10. Thus, the first and second door switches 71 and 73 are turned on, and thus, the refrigerating compartment lighting source 83 and the refrigerating compartment basket lighting source 240 are maintained in the turn-off state.

In this state, the user may recognize the products received in the refrigerating compartment basket assembly 200 without opening the first refrigerating compartment door 410. In more detail, in a state where the first refrigerating compartment door 410 shields the front surface of the refrigerating compartment basket assembly 200, when the user inputs a signal through the lighting button 418, the refrigerating compartment basket lighting source 240 is operated. Thus, the user may recognize the products received in the refrigerating compartment basket assembly 200 through the viewing window 417.

Next, referring to FIG. 2, for opening the front surface of refrigerating compartment basket assembly 200, the first and second refrigerating compartment doors 410 and 420 are rotated with respect to the cabinet 10 to open the front surface of refrigerating compartment basket assembly 200. Here, when the first and/or second refrigerating compartment door(s) 410 and/or 420 is(are) rotated with respect to the cabinet 10, a portion of the front surface or the entire front surface of refrigerating compartment basket assembly 200 is opened.

For example, to open the first refrigerating compartment door 410, thereby opening an upper portion of the front surface of refrigerating compartment basket assembly 200, the user inputs a signal through the input unit 415 disposed on the first refrigerating compartment door 410. Then, when the input unit 415 receives the signal, the door opening driving source 61 is rotated forwardly to allow the door opening driving member 63 to be exposed to the outside of the cabinet 10 through the slot 50. Thus, the first refrigerating compartment door 410 overcomes the attaching forces of the first and second gaskets G1 and G2, and thus is spaced from the front surface of the cabinet 10. Here, the first refrigerating compartment door 410 is rotated at a preset opening angle with respect to the cabinet 10 by the door opening driving member 63.

When the first refrigerating compartment door 410 is rotated at the preset opening angle, the user rotates the first refrigerating compartment door 410 with respect to the cabinet 10 to open the upper portion of the front surface of the refrigerating compartment basket assembly 200. Thus, the user may take the products in or out of the refrigerating compartment assembly and the refrigerating compartment basket assembly 200 through the front surface of the refrigerating compartment basket assembly 200.

When the first refrigerating compartment door 410 is rotated to open the front surface of the refrigerating compartment basket assembly 200, an external force pressing the second door switch 73 is removed. Then, the second door switch 73 protrudes from the inside of the cabinet 10 to the outside and is turned off. Then, the refrigerating compartment basket lighting source 240 is turned on by the turn-off operation of the second door switch 73. Thus, the user may easily take the products in or out of the refrigerating compartment basket assembly 200.

When the preset operation time elapses in a state where the first refrigerating compartment door 410 is rotated at the opening angle by the door opening driving member 63, the door opening driving source 61 is reversely rotated. As a result, the door opening driving member 63 is inserted into the cabinet 10 through the slot 50 due to the reverse rotation of the door opening driving member 63. Thus, the first refrigerating door 410 is rotated with respect to the cabinet 10 by the attaching forces of the first and second gaskets G1 and G2 to shield the front surface of the refrigerating compartment basket assembly 200.

Referring to FIG. 3, to opening the front surface of the refrigerating compartment 13, the refrigerating compartment basket assembly 200 is rotated with respect to the cabinet 10 to allow the refrigerating compartment basket assembly 200 from being separated to the outside of the refrigerating compartment 13. Thus, the front surface of the refrigerating compartment 13 is opened, and simultaneously, the rear surface of the refrigerating compartment basket assembly 200 is opened. Thus, when the front surface of the refrigerating compartment 13 is opened, a portion of the front surface or the entire front surface of the refrigerating compartment basket assembly 200 may be opened by the first and/or second refrigerating compartment door(s) 410 and/or 420 or the front surface of the refrigerating compartment basket assembly 200 may be shielded by the first and/or second refrigerating compartment door(s) 410 and/or 420.

In detail, the user grasps the door handle 230 to pull the refrigerating compartment basket assembly 200. Thus, the refrigerating compartment basket assembly 200 is rotated with respect to the cabinet 10 and separated to the outside of the refrigerating compartment 13. Here, when the portion of the front surface or the entire front surface of the refrigerating compartment basket assembly 200 is shielded, the refrigerating compartment basket assembly 200 is rotated, and simultaneously, the first and/or second refrigerating compartment door(s) 410 and/or 420 is(are) rotated with respect to the cabinet 10.

When the refrigerating compartment basket assembly 200 is separated to the outside of the refrigerating compartment 13, the front surface of the refrigerating compartment 13 and the rear surface of the refrigerating compartment basket assembly 200 are opened. Thus, the user may take the products in or out of the refrigerating compartment 13 and the refrigerating compartment basket assembly 200.

Also, when the refrigerating compartment basket assembly 200 is separated to the outside of the refrigerating compartment 13, the first door switch 71 pushed by the connection part 513 and inserted into the cabinet 10 protrudes outside the cabinet 10. Thus, the first door switch 71 is turned off, and the refrigerating compartment lighting source 83 is turned on by the turn-off operation of the first door switch 71. As a result, the user may easily take the product in or out of the refrigerating compartment 13 by the turn-on of the refrigerating compartment lighting source 83.

Hereinafter, a refrigerator according to a second embodiment will be described in detail with reference to the accompanying drawings.

Figure 8:
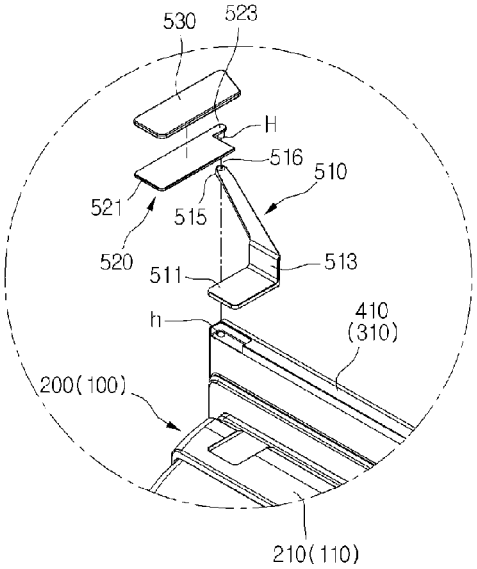
FIG. 8 is an exploded perspective view illustrating a hinge structure of a refrigerator door according to another embodiment.

FIG. 8 is an exploded perspective view illustrating a hinge structure of a refrigerator door according to another embodiment.

In explanations of the current embodiment, the same part as those of the previously described embodiment will be quoted from the reference numerals of FIGS. 1 to 7, and their detailed descriptions will be omitted.

Referring to FIG. 8, in the current embodiment, a first hinge hole 516 is defined in a first hinge coupling part 515 constituting a first hinge bracket 510. A hinge shaft H is integrally disposed on a second hinge coupling part 523 constituting a second hinge bracket 520. The hinge shaft H extends downward from a bottom surface of the second hinge coupling part 523. Also, hinge grooves h are defined in top surfaces of a first freezing compartment door 310 and a first refrigerating compartment door 410, and bottom surfaces of a second freezing compartment door 320 and a second refrigerating compartment door 420, respectively.

Since the hinge shaft H passes through the first hinge hole 516 and is inserted into the hinge grooves h, a freezing compartment basket assembly 100, a refrigerating compartment basket assembly 200, the freezing compartment doors 310 and 320, and the refrigerating compartment doors 410 and 420 are rotated with respect to a cabinet 10. Although not shown, a separate hinge shaft disposed on a virtual straight line extending in the same direction as that of the hinge shaft H is disposed between the first and second freezing compartment doors 310 and 320 and the first and second refrigerating compartment doors 410 and 420.

Figure 9:
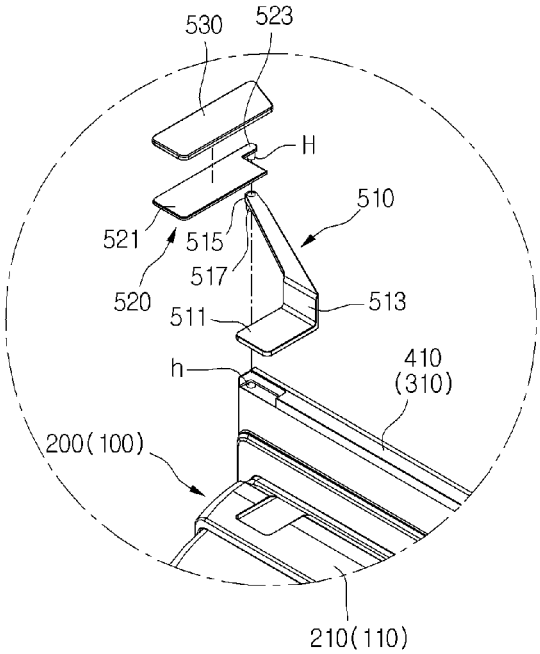
FIG. 9 is an exploded perspective view illustrating a hinge structure of a refrigerator door according to another embodiment.

FIG. 9 is an exploded perspective view illustrating a hinge structure of a refrigerator door according to another embodiment.

In explanations of the current embodiment, the same part as those of the previously described embodiment will be quoted from the reference numerals of FIGS. 1 to 7, and their detailed descriptions will be omitted.

Referring to FIG. 9, in the current embodiment, a hinge boss 517 is disposed on a first hinge coupling part 515 constituting a first hinge bracket 510. The hinge boss 517 extends downward from a bottom surface of the first hinge coupling part 515. Also, a hinge groove is defined inside the hinge boss 517. A hinge shaft H is integrally disposed on a second hinge coupling part 523 constituting a second hinge bracket 520. The hinge shaft H extends downward from a bottom surface of the second hinge coupling part 523. Also, hinge grooves h are defined in top surfaces of a first freezing compartment door 310 and a first refrigerating compartment door 410, and bottom surfaces of a second freezing compartment door 320 and a second refrigerating compartment door 420, respectively.

The hinge shaft H is inserted into the hinge groove of the hinge boss 517, and the hinge boss 517 is inserted into the hinge groove h in a state where the hinge shaft H is inserted. Thus, a freezing compartment basket assembly 100, a refrigerating compartment basket assembly 200, the freezing compartment doors 310 and 320, and the refrigerating compartment doors 410 and 420 are rotated with respect to a cabinet 10. Although not shown, a separate hinge shaft disposed on a virtual straight line extending in the same direction as that of the hinge shaft H is disposed between the first and second freezing compartment doors 310 and 320 and the first and second refrigerating compartment doors 410 and 420.

Figure 10:
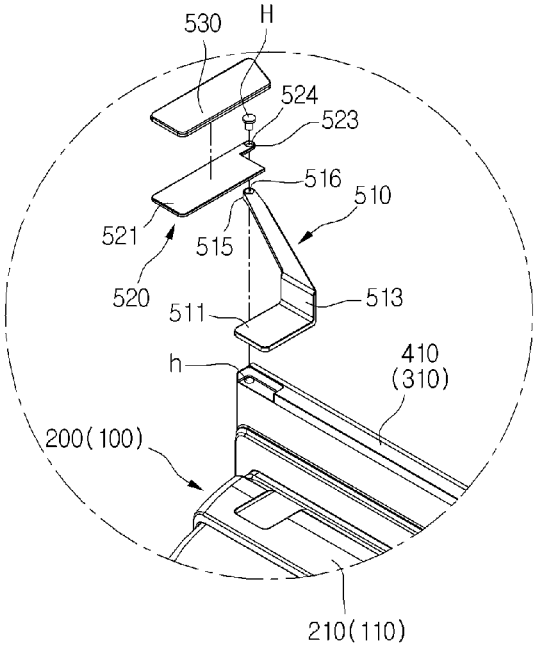
FIG. 10 is an exploded perspective view illustrating a hinge structure of a refrigerator door according to another embodiment.

FIG. 10 is an exploded perspective view illustrating a hinge structure of a refrigerator door according to another embodiment.

In explanations of the current embodiment, the same part as those of the previously described embodiment will be quoted from the reference numerals of FIGS. 1 to 7, and their detailed descriptions will be omitted.

Referring to FIG. 10, in the current embodiment, a first hinge hole 516 is defined in a first hinge coupling part 515 constituting a first hinge bracket 510. A second hinge hole 524 is defined in a second hinge coupling part 523 constituting a second hinge bracket 520. Also, hinge grooves h are defined in top surfaces of a first freezing compartment door 310 and a first refrigerating compartment door 410, and bottom surfaces of a second freezing compartment door 320 and a second refrigerating compartment door 420, respectively.

Since a separate pin or a separate hinge shaft H having a screw shape passes through the first and second hinge holes 516 and 523 and is inserted into the hinge groove h, a freezing compartment basket assembly 100, a refrigerating compartment basket assembly 200, the freezing compartment doors 310 and 320, and the refrigerating compartment doors 410 and 420 are rotated with respect to a cabinet 10. Although not shown, a separate hinge shaft disposed on a virtual straight line extending in the same direction as that of the hinge shaft H is disposed between the first and second freezing compartment doors 310 and 320 and the first and second refrigerating compartment doors 410 and 420.

Figure 11:
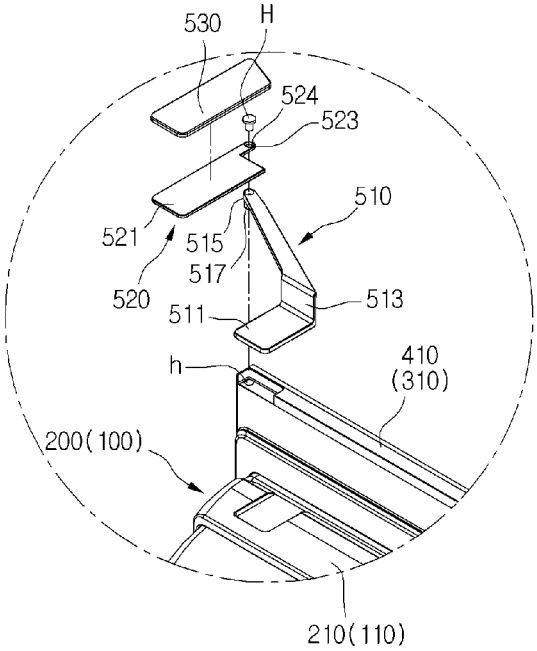
FIG. 11 is an exploded perspective view illustrating a hinge structure of a refrigerator door according to another embodiment.

FIG. 11 is an exploded perspective view illustrating a hinge structure of a refrigerator door according to another embodiment.

In explanations of the current embodiment, the same part as those of the previously described embodiment will be quoted from the reference numerals of FIGS. 1 to 7, and their detailed descriptions will be omitted.

Referring to FIG. 11, in the current embodiment, a hinge boss 517 is disposed on a first hinge coupling part 515 constituting a first hinge bracket 510. The hinge boss 517 extends downward from a bottom surface of the first hinge coupling part 515. A hinge hole 524 is defined in a second hinge coupling part 523 constituting a second hinge bracket 520. Also, hinge grooves h are defined in top surfaces of a first freezing compartment door 310 and a first refrigerating compartment door 410, and bottom surfaces of a second freezing compartment door 320 and a second refrigerating compartment door 420, respectively.

Since a separate pin or a separate hinge shaft H having a screw shape passes through the hinge hole 523 and is inserted into the hinge boss 517 and the hinge boss 517 in which a hinge shaft H is inserted into the hinge groove h, a refrigerating compartment basket assembly 200, the freezing compartment doors 310 and 320, and the refrigerating compartment doors 410 and 420 are rotated with respect to a cabinet 10. Although not shown, a separate hinge shaft disposed on a virtual straight line extending in the same direction as that of the hinge shaft H is disposed between the first and second freezing compartment doors 310 and 320 and the first and second refrigerating compartment doors 410 and 420.

Figure 12:
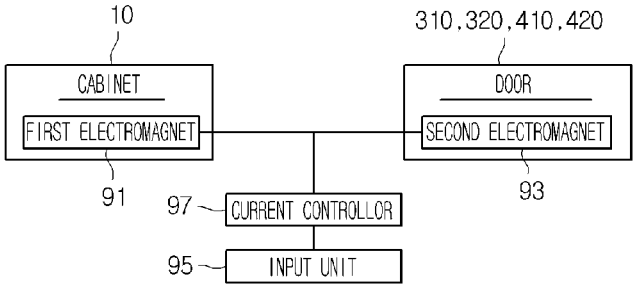
FIG. 12 is a schematic block diagram illustrating a configuration of a door opening mechanism according to another embodiment.

FIG. 12 is a schematic block diagram illustrating a configuration of a door opening mechanism according to another embodiment.

In explanations of the current embodiment, the same part as those of the previously described embodiment will be quoted from the reference numerals of FIGS. 1 to 7, and their detailed descriptions will be omitted.

Referring to FIG. 12, a first electromagnet 91 is disposed on a front surface of a cabinet 10. A second electromagnet 93 may be disposed on a back surface of freezing compartment doors 310 and 320 and refrigerating compartment doors 410 and 420 disposed at a position corresponding to that of the first electromagnet 91. An input unit 97 receives a signal for opening the freezing compartment doors 310 and 320 and the refrigerating compartment doors 410 and 420. An attractive or repulsive force is generated between the first and second electromagnets 91 and 93 by a current controller 97.

In detail, in a state where the freezing compartment doors 310 and 320 and the refrigerating compartment doors 410 and 420 are closed, i.e., back surfaces of the freezing compartment doors 310 and 320 and the refrigerating compartment doors 410 and 420 are closely attached to a front surface of the cabinet 10, when the input unit 97 receives a signal for opening the freezing compartment doors 310 and 320 and the refrigerating compartment doors 410 and 420, the current controller 97 controls current supplied into the first and second electromagnets 91 and 93 to generate the repulsive force between the first and second electromagnets 91 and 93.

The current controller 97 controls the current supplied into the first and second electromagnets 91 and 93 so that the repulsive force between the first and second electromagnets 91 and 93 exceeds an attaching force of first and second gaskets G1 and G2 and the freezing compartment doors 310 and 320 and the refrigerating compartment doors 410 and 420 are rotated with respect to the cabinet 10 at a preset opening angle. When a preset first operation time elapses after the input unit 97 receives the signal for opening the freezing compartment doors 310 and 320 and the refrigerating compartment doors 410 and 420, the current controller 97 may control the current supplied into the first and second electromagnets 91 and 93 to generate the repulsive force between the first and second electromagnets 91 and 93 for a preset second operation time.

According to the above-described control method, the freezing compartment doors 310 and 320 and the refrigerating compartment doors 410 and 420 are rotated with respect to the cabinet 10 at the opening angle by the repulsive force between the first and second electromagnets 91 and 93 for the first operation time to open a freezing compartment 11 or a refrigerating compartment 13. When the freezing compartment doors 310 and 320 and the refrigerating compartment doors 410 and 420 rotated with respect to the cabinet 10 at the opening angle are not further rotated within the first operation time by the user, the attractive force acts between the first and second electromagnets 91 and 93. That is, the freezing compartment doors 310 and 320 and the refrigerating compartment doors 410 and 420 are reversely rotated with respect to the cabinet 10 to shield the freezing compartment 11 or the refrigerating compartment 13.

Figure 13:
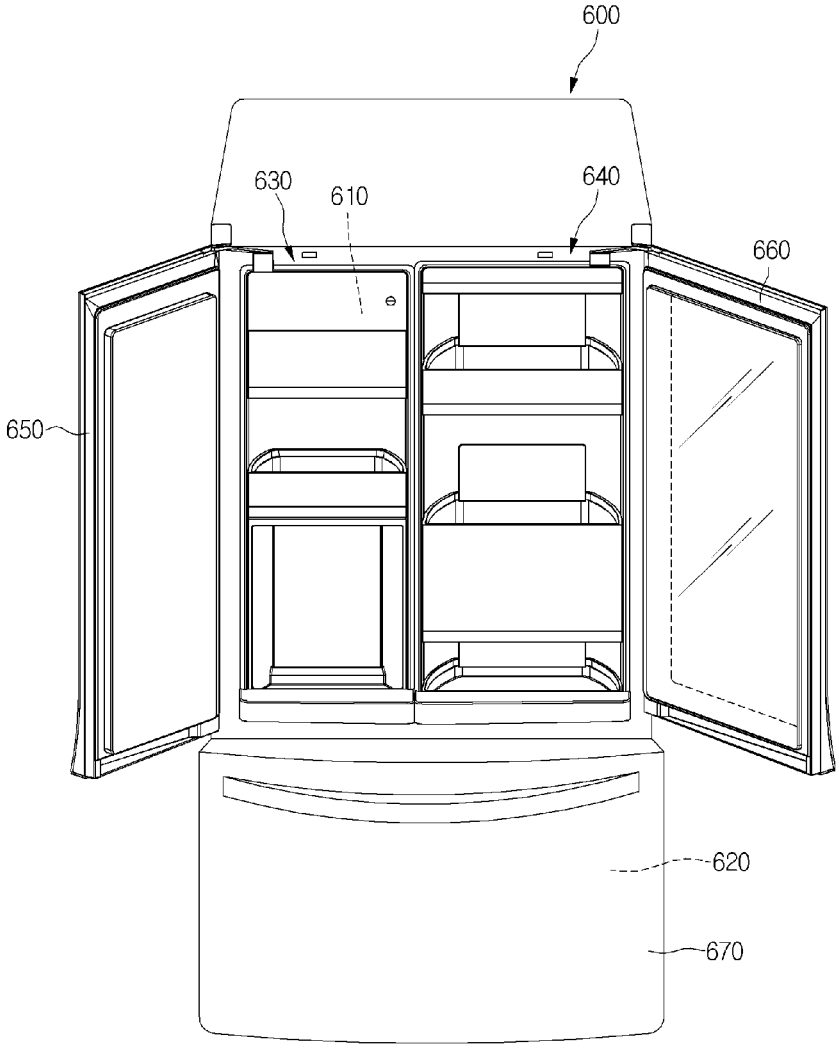
FIG. 13 is a perspective view of a refrigerator according to another embodiment.

FIG. 13 is a perspective view of a refrigerator according to another embodiment.

Referring to FIG. 13, in the current embodiment, a refrigerating compartment 610 and a freezing compartment 620 defined inside a cabinet 600 are vertically partitioned. Each of front surfaces of the refrigerating compartment 610 and the freezing compartment 620 is opened, and products to be stored in a frozen or refrigerated state are taken in or out through the opened front surfaces of the refrigerating compartment 610 and the freezing compartment 620.

Also, first and second basket assemblies 630 and 640 are detachably disposed on the inside and outside of the refrigerating compartment 610. The first and second basket assemblies 630 and 640 are rotatably disposed on the cabinet 600. The first and second basket assemblies 630 and 640 selectively open or close the front surface of the refrigerating compartment 610. Front and rear surfaces of the first and second basket assemblies 630 and 640 are opened to take the product in or out therethrough. That is, like the foregoing embodiments, the products may be taken in or out through front or rear sides of the basket assemblies 630 and 640.

The front surfaces of the first and second basket assemblies 630 and 640 disposed inside the refrigerating compartment 610 are opened or closed by first and second refrigerating compartment doors 650 and 660. Each of the first and second refrigerating compartment doors 650 and 660 is rotatably disposed with respect to the cabinet 600.

The front surface of the freezing compartment 620 is selectively opened or closed by a freezing compartment door 670. The freezing compartment door 670 opens or closes the freezing compartment 620 in a drawer-type. A basket (not shown) is disposed on a back surface of the freezing compartment door 670. Substantially, the products to be stored in the frozen state are received into the basket.

Figure 14:
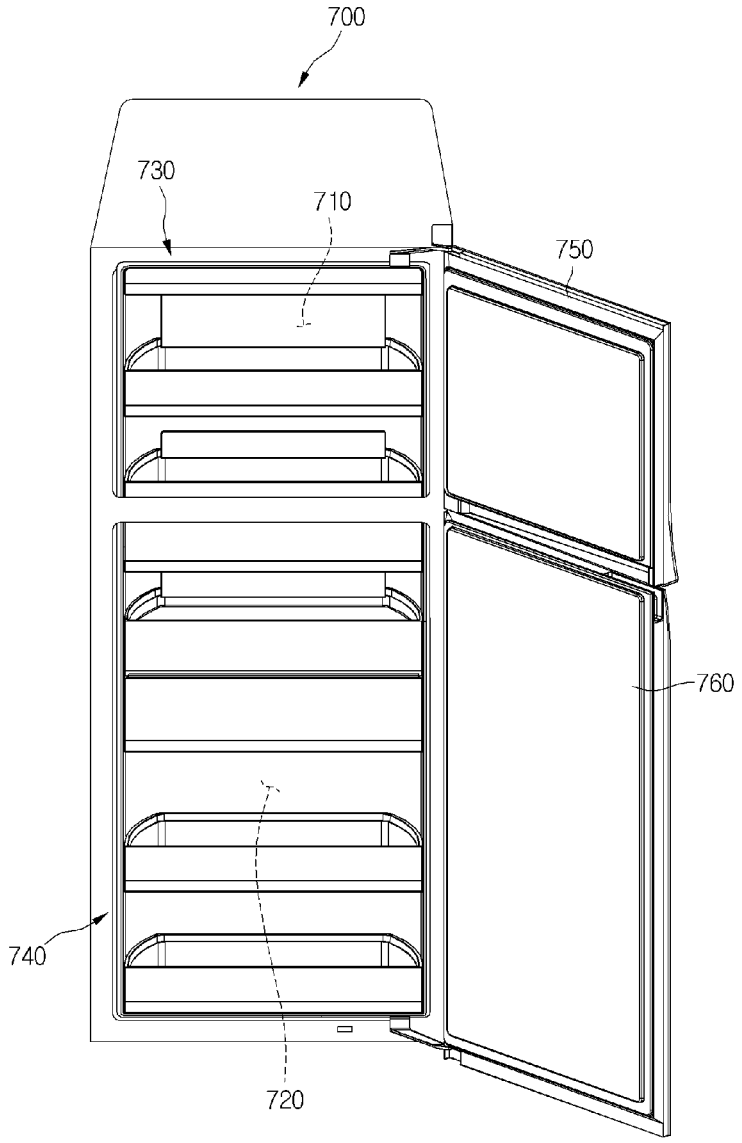
FIG. 14 is a perspective view of a refrigerator according to another embodiment.

FIG. 14 is a perspective view of a refrigerator according to another embodiment.

Referring to FIG. 14, in the current embodiment, a freezing compartment 710 and a refrigerating compartment 720 defined inside a cabinet 700 are vertically partitioned. Each of front surfaces of the freezing compartment 710 and the refrigerating compartment 720 is opened, and products to be stored in a frozen or refrigerated state are taken in or out through the opened front surfaces of the freezing compartment 710 and the refrigerating compartment 720.

The front surfaces of the freezing compartment 710 and the refrigerating compartment 720 are selectively opened or closed by a freezing compartment basket assembly 730 and a refrigerating compartment basket assembly 740, respectively. The freezing compartment basket assembly 730 and the refrigerating compartment basket assembly 740 are rotatably disposed in a side-swing type. The products are taken in or out of the freezing compartment basket assembly 730 and the refrigerating compartment basket assembly 740 through opened front and rear surfaces of the freezing compartment basket assembly 730 and the refrigerating compartment basket assembly 740.

Also, the opened front surfaces of the freezing compartment basket assembly 730 and the refrigerating compartment basket assembly 740 are selectively opened or closed by a freezing compartment door 750 and a refrigerating compartment door 760, respectively. The freezing compartment door 750 and the refrigerating compartment door 760 are rotatably disposed on the cabinet 70 in the side-swing type.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A refrigerator, comprising:

a cabinet defining a storage chamber of which a front surface is open;

a basket assembly, the basket assembly including:

a frame rotatable with respect to the cabinet and having a pair of access openings passing therethrough;

a plurality of baskets arranged in the access openings; and a door handle projected from a front surface of the frame and having a grasping groove recessed therein;

a first door which is opened by rotating in a same direction as a rotation direction of the basket assembly, the first door configured to open or close one of the pair of access openings;

a second door which is opened by rotating in the same direction as the rotation direction of the basket assembly, the second door configured to open or close the other of the pair of access openings;

a first hinge enabling the first door and the second door to respectively rotate; and a second hinge enabling the basket assembly to rotate, wherein one of the first door and the second door defines a handle shield part covering at least a portion of the door handle.

2. The refrigerator according to claim 1, wherein the door handle comprises:

an extension portion extending frontward from the front surface of the frame; and a front portion extending after being bent at an end of the extension portion, wherein the handle shield part comprises:

a first surface covering the front portion by facing the front portion; and a second surface covering the extension portion by facing the extension portion.

3. The refrigerator according to claim 2, further comprising a gasket disposed at a position where the front surface of the frame and a rear surface of the door are in close contact with each other.

4. The refrigerator according to claim 2, wherein a front end of the handle shield part defined in the one of the first door and the second door is further protruded forward than a front end of the other of the first door and the second door.

5. The refrigerator according to claim 4, wherein the one of the first door and the second door is disposed below the other of the first door and the second door.

6. The refrigerator according to claim 1, further comprising a door opening apparatus configured to open the first door and the second door.

7. The refrigerator according to claim 1, wherein a rear surface of the first door or the second door is in close contact with a front surface of the cabinet when the first door or the second door is in a closed position, wherein the refrigerator further comprises a gasket disposed along the rear surface of the first door or the second door which is in close contact with the front surface of the cabinet.

8. The refrigerator according to claim 1, wherein an edge of the one of the first door and the second door which defines the handle shield part is extended to an entrance of the grasping groove.

9. A refrigerator, comprising:

a cabinet defining a storage chamber of which a front surface is open;

a basket assembly, the basket assembly including:

a frame rotatable with respect to the cabinet, accommodated in the storage chamber in a closed position, and having an access opening passing therethrough;

a plurality of baskets arranged in the access opening; and a door handle projected from a front surface of the frame and having a grasping groove recessed therein;

a door which is opened by rotating in a same direction as a rotation direction of the basket assembly, the door including a handle shield part which covers a front surface of the door handle such that the front surface of the door handle is not exposed when the door is in a closed position to close a front surface of the access opening;

a first hinge enabling the door to rotate;

a second hinge enabling the basket assembly to rotate; and a gasket disposed at a position where the front surface of the cabinet and a rear surface of the door are in close contact with each other, and configured to block leakage of cold air from the storage chamber, wherein the door includes:

a first door having the handle shield part; and a second door additionally disposed proximate to the first door, wherein the first door is a predetermined distance away from the second door to allow access of a user's hand to the grasping groove, and wherein a front end of the door handle is further protruded forward than a front end of the second door which is proximate to the door handle.

10. The refrigerator according to claim 9, wherein the door handle comprises:

an extension portion extending frontward from the front surface of the frame; and a front portion extending after being bent at an end of the extension portion, wherein the handle shield part comprises:

a first surface covering the front portion by facing the front portion; and a second surface covering the extension portion by facing the extension portion.

11. The refrigerator according to claim 9, further comprising a gasket disposed at a position where the front surface of the frame and a rear surface of the door are in close contact with each other.

12. The refrigerator according to claim 9, wherein the handle shield part is configured to be slanted or rounded frontward with respect to a front surface of the door to cover the door handle.

13. The refrigerator according to claim 12, wherein the front surface of the door handle is configured to be slanted or rounded along a profile of the handle shield part.

14. The refrigerator according to claim 9, wherein the second door is disposed below the first door, and a lower end of the first door is a predetermined distance away from an upper end of the second door.

15. The refrigerator according to claim 9, wherein a front end of the handle shield part is further protruded forward than a front end of the second door that corresponds to the handle shield part.

16. The refrigerator according to claim 9, wherein an edge portion of the second door that corresponds to the handle shield part is configured to be slanted or rounded rearward to be positioned rearward of the handle shield part.

17. The refrigerator according to claim 9, wherein the first hinge and the second hinge are configured to share a same rotational axis.

18. The refrigerator according to claim 9, wherein an edge of the first door which defines the handle shield part is extended to an entrance of the grasping groove.

19. The refrigerator according to claim 9, further comprising a door opening apparatus configured to open the door.

* * * * *